United States Patent [19]

Kobayashi

[11] Patent Number: 4,679,671

[45] Date of Patent: Jul. 14, 1987

[54] BAND CLAMPING DEVICE FOR LUGGAGE TRANSPORTATION

[75] Inventor: Hiroshi Kobayashi, Tokyo, Japan

[73] Assignee: Kabushiki Kaisha Sankodo, Tokyo, Japan

[21] Appl. No.: 723,460

[22] Filed: Apr. 15, 1985

[30] Foreign Application Priority Data

| | | | |
|---|---|---|---|
| Jul. 5, 1984 | [JP] | Japan | 59-100698[U] |
| Aug. 31, 1984 | [JP] | Japan | 59-131483[U] |
| Dec. 28, 1984 | [JP] | Japan | 59-196865[U] |

[51] Int. Cl.[4] ..... A45C 13/30

[52] U.S. Cl. ..... 190/115; 150/107; 24/136 R; 24/171; 24/194

[58] Field of Search ..... 150/107, 108; 190/115; 24/136 R, 115 G, 171, 194, 198, 265 R, 457, 458, 522, 526–528, 532, 536, 537

[56] References Cited

U.S. PATENT DOCUMENTS

| | | | |
|---|---|---|---|
| 166,022 | 7/1875 | Mihills | 24/526 |
| 579,297 | 3/1897 | Ettinger | 24/171 |
| 783,064 | 2/1905 | McCord | 24/171 |
| 1,007,369 | 10/1911 | McGowan | 24/136 R |
| 1,319,547 | 10/1919 | White | 24/194 |
| 1,545,889 | 7/1925 | Everson | 24/136 R |
| 2,377,287 | 5/1945 | White et al. | 24/171 |
| 2,642,641 | 6/1953 | Van Buren, Jr. | 24/198 |
| 3,103,725 | 9/1963 | Robb et al. | 24/136 R |
| 4,019,609 | 4/1977 | Wagner | 24/136 R |
| 4,038,726 | 8/1977 | Takabayashi | 24/198 |
| 4,273,274 | 6/1981 | Freistadt | 150/108 |
| 4,484,379 | 11/1984 | Appelt et al. | 24/198 |
| 4,614,007 | 9/1986 | Else | 24/136 R |

FOREIGN PATENT DOCUMENTS

| | | | |
|---|---|---|---|
| 541017 | 7/1922 | France | 24/136 R |
| 1108088 | 1/1956 | France | 24/115 G |

*Primary Examiner*—William Price
*Assistant Examiner*—Gary E. Elkins
*Attorney, Agent, or Firm*—Lalos, Keegan & Kaye

[57] ABSTRACT

A pair of bands (bands of both sides may be connected at bottom surface) are attached in inverted U-shape along both side surfaces (only one side will do if hand holding condition is not needed) of a large size bag and the like, and a cramping device of an upper portion of the inverted U-shape band is formed in a special adjusting mechanism according to this invention, and when the band is shifted in vertical and horizontal directions against these cramping devices and is fixed, the length and the interval of the shouldering band can be properly adjusted so as to match a physical constitution (height and size of shoulders) of user of bag. After the length and the interval are properly adjusted, there is no shift of band at all even if the band is pulled. Three embodiments of this invention, where the camping device of the band of this invention is attached to the bag as the part of the product, and where it is used as the band for shouldering small size carrying item, and where it is used as an implement for shouldering any luggage on his back will be described in the text of specification.

12 Claims, 18 Drawing Figures

A

B

C

A

B

C

BAND CLAMPING DEVICE FOR LUGGAGE TRANSPORTATION

RELATED APPLICATION

This patent application is a Convention priority claimed application based on the following three applications filed in Japan by the present applicant:

1. Japanese Utility Model Registration Application No. 59(1984)-100698 "Universal Band Cramp of a Bag and the like"
2. Japanese Utility Model Registration Application No. 59(1984)-131483 "A Band Cramp for Carrying a Rigid Carrier on the Back"
3. Japanese Utility Model Registration Application No. 59(1984)-196865 "Carrying Belt"

BACKGROUND OF THE INVENTION

This invention generally relates to a luggage transporting device, and more particularly, its object is to provide a clamping device adapted to allow an easy adjustment of a length and distance of parallel bands or belts spanned over both shoulders according to the physical constitution of a user when a relatively heavy piece of luggage is transported by carrying it on his shoulders.

The foregoing Japanese applications are embodiments showing different modes of using the clamping device for shoulder bands according to the present invention, and are utility models in which kinds of materials to be transported and detail structure of the clamping device are different, but it should be understood that they are based on the identical operation and principle.

BRIEF SUMMARY OF THE INVENTION

The details of different modes of this invention will be described in the following by referring to preferred embodiments sequentially, but the identical operation and principle applied to all of them are as follows.

(a) An inverted U-shaped carrying band can be mounted at least at one side of a piece of luggage to be carried.

(b) A length and a distance of a parallel portion of the carrying band can be easily adjusted.

(c) The once adjusted length and the distance of the carrying band are not changed during use by a firm engagement between the clamping device and the carrying band.

BRIEF DESCRIPTION OF THE DRAWINGS

FIG. 1 through FIG. 4 are drawings illustrating a first embodiment of this invention, a universal band clamping device for bags;

FIG. 1 is a perspective view illustrating a travel bag having a universal band clamping device of a first embodiment, FIG. 2 is a cross section of the clamping device illustrated in FIG. 1 and showing a condition where the band is clamped.

FIG. 5 is a perspective view showing an entire body of the carrying band clamping device of the second embodiment, FIG. 6 is a cross section taken along a line VI—VI of FIG. 1.

FIG. 7 is a perspective view showing 3 examples of an engaging member of the band.

FIG. 8 is a schematic view showing 3 examples of the use of the second embodiment.

FIG. 9 is a perspective view of an entire carrying belt of the third embodiment.

FIG. 10 is a perspective view of the carrying belt showing a condition where the belt is mounted on an article to be carried.

FIG. 11 is an enlarged view of a belt hooking member.

FIG. 12 is a cross section taken along a line XII—XII of FIG. 9 showing an inside of a bar member.

DESCRIPTION OF THE PREFERRED EMBODIMENT

Figure 1:
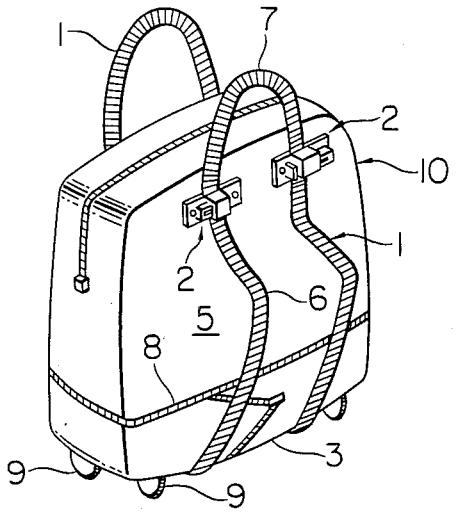

'FIG. 1 is a perspective view illustrating a traveler's bag 10 having a universal band 1 according to the first embodiment, and its clamping devices 2, 2 are considerably enlarged for easy understanding. The band 1 is attached to a bottom portion 3 of the bag 10 by means of rivet or a clasp, not shown, in such a way that the band 1 is attached on both sides of the bag 10 individually or forms an inverted U-shape continuously (or a similar clamping device may be provided on the bottom portion to allow mutual adjustment of lengths of the bands on both surfaces). Each inverted U-shaped band 1 is provided with a rising portion 6 extending upward along the side 5 of the bag and a handheld portion 7 extending upwardly along the bag. In other words, the band 1 is classified into a handle 7 of the upper part and a carrying band 6 of the lower part by the clamping device 2. This clamping device 2, as will be described in detail, can be adjusted to fit the band 1 to the following various using conditions according to various using conditions of the bag and the physical constitution of a user by fixing the band 1 to the clamping device 2 after optionally shifting vertically and horizontally.

(a) Adjust the handle 7 as to length and height.

(b) Adjust the length of the handle 7 accordingly when the volume or the height of the bag is changed by a zip-fastener 8 the lower part of the bag 10.

(c) Adjust the length of the handle 7 by matching the position of the hand of a user when the bag is wheeled over the floor by its casters 9 on the bottom portion of the bag.

(d) In case the bag 10 is to be shouldered on the back of the user, extend the portion of the carrying band 6 to carry the bag on his back like a knapsack (Namely, the handle 7 becomes shorter proportionately. Also, in case the bands are attached on both surfaces, the adjustment can be made from the band of opposite side.)

(e) Adjust the position of the carrying band 6 vertically and horizontally according to the physical constitution of user, concretely, according to the width of the user's shoulders and thickness of his arms.

Figure 2:
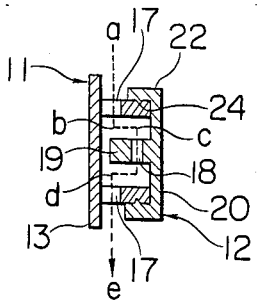
Figure 3A:
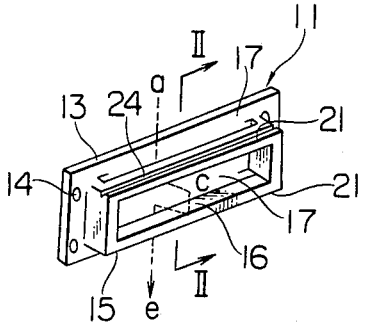
FIG. 3A and FIG. 3B are perspective views showing a base portion (groove portion) of the clamping device.
Figure 4A:
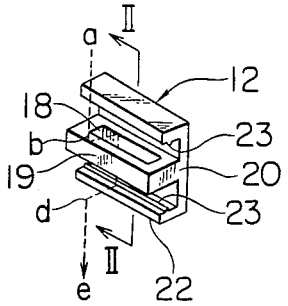
FIG. 4A and FIG. 4B are perspective views showing a fitting portion (sliding portion) of the clamping device.
Figure 3B:
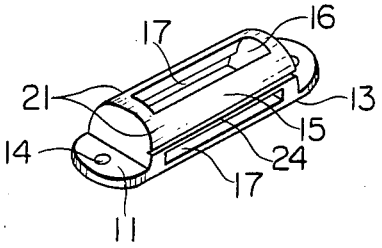
Figure 4B:
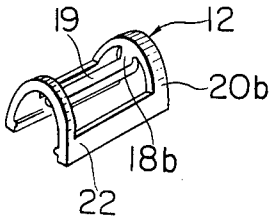

The detail of the universal band clamping device 2 will be described in the following by referring to FIG. 2 through FIG. 4. The clamping device 2 schematically shown in FIG. 1 comprises a base portion or a slide groove portion 11 fixed to the side of the bag by rivets or the like, and a fitting portion or a sliding portion 12 that fits to the base portion and slides along this groove. FIGS. 3A and 3B illustrate 2 examples of the base portion, and FIGS. 4A and 4B are perspective views showing 2 examples of the fitting portions corresponding to the base portions respectively which are shown in FIGS. 3A and 3B. FIG. 2 is a cross section taken along a line II—II in using condition of the clamping device in which the fitting portion of FIG. 4A is fitted to the base portion of FIG. 3A, and is a drawing showing the position of the band in dotted lines.

The band clamping device 2 of this embodiment, in a nutshell, is a universal band clamping device capable of fixing the band 1 that runs through the clamping device to the position by shifting the band optionally vertically and horizontally according to the using condition of the band or according to the physical constitution of user.

An example A and example B to be described hereinafter are merely different in that the latter has a round configuration when compared with the former, and that the belt is exposed on the fitting portion in the fitted condition, and thus, the description will be made by attaching identical symbols to identical portions.

FIGS. 3A and 3B show a base portion or a groove portion 11 to be fixed to an upper portion of the side of the bag 10, and is provided with an elongate base 13 having a mounting hole 14 for mounting on the side of the bag 10 and an elongate frame 15 integrally molded upwardly from the base, for example, by plastics. The upper surface of the elongate frame 15 is open by forming an elongate slot or groove portion 16, and on its both sides, an elongate opening 17, of almost the same length as the groove portion 16 of the upper surface, is formed. The height (vertical gap width) of these openings 17, as will be described hereinafter, is such as to allow the passing of the band 1, but the length (lateral width of opening 17) is extended by a required lateral distance beyond the band when compared with the width of the band.

FIGS. 4A and 4B illustrate a fitting portion or a sliding portion 12 capable of fitting and lateral sliding to the base portion 11 of FIGS. 3A and 3B, and comprises a bracket portion 19 for liftably supporting the band 1 in the base portion 11 upon hooking it, and a side leg portion 22 formed integrally with the bracket portion 19 and being fitted to sandwich the base portion along both sides of the elongate frame 15 of the base portion 11.

In the embodiment A, the leg portion 22 at both sides is integrally formed by an upper plate portion 20, and the band 1 passes through a slit 18 between the upper plate portion 20 and the bracket 19, while in the embodiment B, the leg portion 22 at both sides is connected by a bridge portion **20*b* of both ends so that the band 1 (shown by dotted line a→e) lifted by the bracket portion 19 is in the condition of being seen from the outside, and accordingly, the portion corresponding to the slit 18** in the embodiment A becomes an upwardly open space, and when the position of the band changes as will be described hereinafter, the band can be picked up from the outside so that it is convenient in case of shifting the band.

On the inside of the leg portion 22 of the fitting portion 12 and on the outside of the elongate frame 15 of the base portion, a proper projection 23 and a concave portion 24 may be provided for providing a snapping action for controlling the fitting sandwiching position of the leg portion 22 and the frame 15 and a sliding action of the fitting portion 12. In the fundamental operation of this invention, this fitting and sliding relationship is not indispensable, and this can be understood from the fact that the fitting portion 12 of the clamping device 2 is always biased toward the base portion 11 by the tensile force in the using condition of the band itself.

FIG. 2 shows a condition in which the fitting portion 12 of FIG. 4A is fitted to the base portion 11 of FIG. 3A, and the band 1 is greatly refracted inside of the base portion 11 as shown by dotted lines a, b, c, d and e, and is curved like (b) in almost right angles at the inner edge portion of the opening 17, and bends at right angles twice like (c) by being lifted by the bracket portion 19, and is refracted almost at right angles like (d) at the opening portion 17 of opposite side and be drawn like (e) to the outside of the clamping device 2. This condition will be understood as shown in dotted lines a→e in each drawing of FIGS. 3 and 4.

The operation of the universal band clamping device 2 of the first embodiment will be described primarily in the following by referring to FIG. 2.

The insertion of the band 1 into the clamping device 2 can be carried out optionally after complete manufacture of bag 10 in case there is a clasp connecting portion not shown on the part of the band, but in case the band is not provided with the clasp connection portion as shown in FIG. 1, the band 1 is required to be inserted through the clamping device 2 before being fixed to the bottom portion 3 at the time of manufacture of the bag. A path for the insertion of the band 1 into the clamping device 2 is such as shown in dotted line in cross section of FIG. 2 that it passes through the one opening 17 of the base portion 11, and passes over the bracket portion 19 of the fitting portion 12 through the inside of the elongate frame 15 and comes outside by passing through the other opening 17 of the base portion 11 through the inside of the elongate frame 15 again. As described, it will be easily understood that the passing of the band can be easily carried out in the initial condition where both portions 11 and 12 of the clamping device 2 are separated. Namely, after the band 1 is inserted through the groove portion 11 and the fitting portion 12 of the clamping device 2 in this order, and when the clamping device 2 is fitted in the condition of FIG. 2 while pulling the band properly in the vertical direction, the band 1 becomes fixed at a desired position in the vertical and horizontal directions against the clamping device 2. Because, the band 1 can be fixed at the desired position according to the using condition of the bag 10, and particularly, in the shouldering condition, the length and the interval of the shoulder band 6 can be optionally adjusted according to the physical constitution of the user, and the tensile force of the band 1 in use is blocked by the frictional engaging force of each opening 17 of the clamping device and the edge portion of the bracket portion 19 which is produced by the refraction of the band like the dotted line and a phenomenon of shifting the band does not occur. By the way, if the bracket portion 19 is formed in a length abutting on the base portion in FIG. 2, although FIG. 2 shows the bracket portion in length not contacting the upper surface of the base portion 11, the bracket portion 19 of the fitting portion 12 is a particularly preferable design since there is an advantageous point that the tensile force of the band 1 is not directly exerted over the upper plate 20 or the bridge portion **20*b* of the fitting portion and an advantageous point that the sandwiching action of the outer surface 21** of the base frame 15 by the leg portion 22 at both sides of the fitting portion 12 is not obstructed.

As it is already understood, in case the user intends to shift the position of the band 1 against the clamping device 2 in vertical direction and also to shift it in horizontal direction, the user picks up the fitting portion (or the sliding portion) 12 with his finger tip (in the example B, it is possible to pick up the refracted portion of the band directly), pushing the band 1 into the clamping device 2 slightly with the other finger tip to loosen the frictional force of the inside, whereby the desired vertical adjustment (shifting) or the horizontal sliding (band interval adjustment) can be easily and optionally carried out.

By the way, attention should be paid to the fact that both leg portions 22 of the sliding portion 12 is not merely a guide projecting member for sliding motion but also has a sandwiching action for holding down the frames 15 at both sides of the base portion 11 against the bending force outwardly caused by the tension of the band when the band 1 is in use.

As described in the foregoing, the universal band clamping device 2 of the first embodiment has added a versatility and convenience in that the adjustment of the shoulder band 6 against the width of shoulders at the time of carrying the bag 10 on his back and the thickness of the arms in addition to complying to the hand-held condition of the bag, and the caster using condition.

Although it is matter of course, minor modifications such as the integral formation of the base portions of two right and left clamping devices, and the provision of the stiffening plates for reinforcement on the inner surface of the bag may be easily carried out by those who are in the art.

The second embodiment of this invention will be described in the following. The clamping device of the first embodiment is provided for a subject that is soft and whose volume is not constant such as bags, but this device utilizes a lateral bar of a rigid carrier for an easy change of a universal carrying band against a frame or box type rigid carrier according to a physical constitution of user, utilizes a principle of mounting the lateral bar constituting the part of the clamping device and folding the band into two parts and inserting them into the through groove provided in the axial direction of the lateral bar and inserting a separate lateral bar into the two folded band and pulling both ends of the band and fixing them at the positions. Other advantageous points accompanying thereof will be described in detail in the following by referring to drawings.

Figure 5:
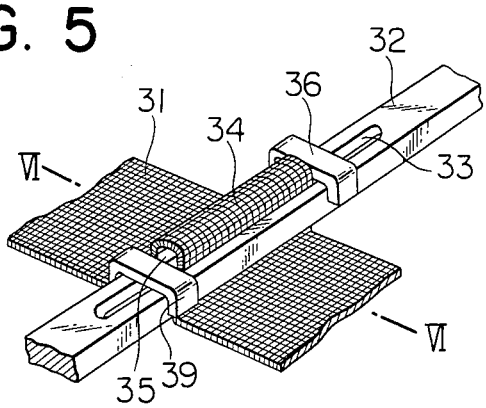
FIG. 5 through FIG. 8 are drawings illustrating a second embodiment of this invention, a carrying band clamping device for a rigid carrier.
Figure 8:
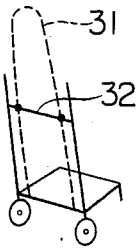
Figure 8:
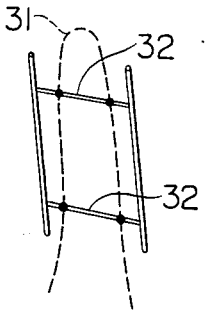
Figure 8:
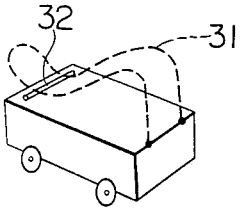

FIG. 5 is a perspective view showing an entire universal clamping device of shoulder band according to this device in which a band 31 is inserted in folded condition 34 into a slot or groove 33 in the axial direction of the lateral bar portion 32 of the carrying device, for example, a hand carrier A, a shoulder frame B or a box type cart C as briefly illustrated in FIG. 8 (in case of the box type cart, a lateral bar added as for stopper). The band 31 inserted into the groove 33 in folded condition 34 slips from groove 33 if it is pulled as it is so that a proper bar 35 is inserted into the two folded portion of the band for prevention of slippage.

Figure 6:
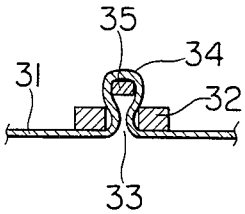

FIG. 6 is a cross section taken along a line VI—VI of FIG. 5, and the bar 35 inserted into the two-folded portion 34 of the band mentioned above is understood to work to hold the condition where the two folded portion 34 of the band do not slip from the through groove 33 even if the tension is applied to the band 31 again.

Figure 7:
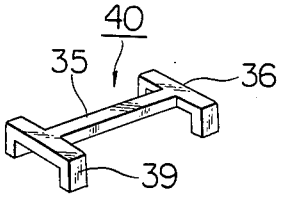
Figure 7:
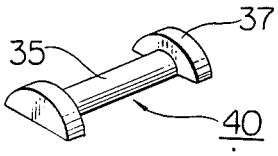
Figure 7:
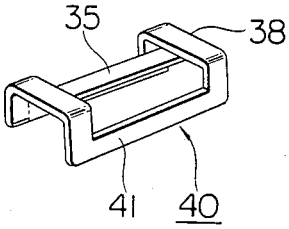

However, this slip preventing bar 35 is not a simple straight bar and, for example, as shown in three examples in FIG. 7, slip preventing projecting members 36, 37, 38 for the band 31 are provided at both end portions of the bar portion 35 in a condition where almost the width of the band 31 is retained from both sides. The projecting member 36 shown in FIG. 5 is similar to the example of A of FIG. 7, but it can be made like the projecting member 37 or 38 as shown in B or C of FIG. 7. The slip preventing member 40 of A, B and C of FIG. 7 has an inherent action of preventing the two-folded portion 34 of the band slipping from the through groove 33 and holding the length of the shoulder band not to be changed from the position, and in addition, has an action of reinforcing the lateral bar 32 with the bent portion 39 that sandwiches the lateral bar 32 from the outside of the through groove 33 and in case of a need removing the slip preventing bar 35 by greatly expanding the two-folded portion 34 of the band. The slip preventing bar of FIG. 7B is the simplest example having no action of sandwiching the lateral bar 32. FIG. 7C shows that the portion 41 sandwiching the lateral bar 32 extends along the outside of the lateral bar 32 so that the action of reinforcing the lateral bar is great proportionately but this slip preventing member 40 cannot be removed by merely expanding the two-folded portion 34 of the band, and thus, it is disadvantageous in some aspect or there is an advantageous point that a chance of missing is small.

In case the length of the slot or groove 33 of the lateral bar 32 is arranged to be prolonged properly when compared with the width of the shoulder band 31, it is obvious that the frictional engagement of the band with the groove in the condition where the band 31 is properly loosened can be decreased whereby the interval of the two shoulder bands 31 can be changed when the projecting member of the slip preventing member 40 is moved along the groove of the lateral bar.

The foregoing description illustrates the universal band clamping device capable of easily adjusting the length and the distance of a pair of shoulder bands utilizing the lateral bar or adding a lateral bar against the hand carrier, shoulder frame or other rigid carriers, but in general, it should be understood that the clamping device can be applied as the universal band clamping device to a portable structure such as tent, chairs, beds, baby carriages and the part of ship's fittings.

The third embodiment of this invention will be described in the following. In this case, particularly where ordinary carrying items or bags are carried rather than bags attached initially with specific carrying belts, this device is to provide a carrying belt adapted to provide extremely easily a desired shouldering mechanism which does not need to form a shouldering mechanism every time by using a cord or rope for individual carrying items, and is capable of being adjusted correspondingly easily even though sizes of the carrying items are variable to a certain degree. The brief description of the carrying belt is as follows, in which a piece of endless belt and a pair of bars which is crossed with the endless belt and fixed to be able to change their positions at two locations of the endless belt are provided, and the carrying item is supported by two parallel sides of the endless belt and a shouldering mechanism of the carrying items is easily formed by tieing a pair of bars mutually at parallel positions.

Figure 9:
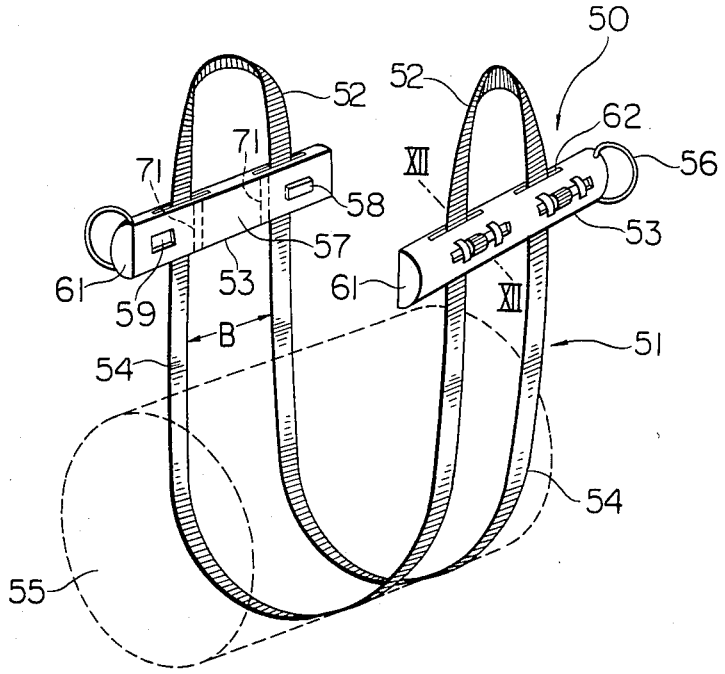
FIG. 9 through FIG. 12 are drawings illustrating a third embodiment of this invention, a carrying belt.

FIG. 9 is an entire perspective view of a carrying belt 50 of this embodiment, and an endless belt 51 and a pair of bars 53 being mounted crossing with the endless belt 51 at two locations of the endless belt 51 at positions leaving U-shaped handle portions 52 respectively.

A pair of bars 53 is fixed to the endless belt 51 to be able to change the mounting position by the construction to be described hereinafter, and the endless belt 51 is classified into a parallel belt section 54 between the bars and a handle portion 52 at outside of each bar 53. An article 55 shown as a cylindrical rice-bag with dotted lines in FIG. 9 is an illustration representing an optional shape carrying item to be carried simply and lightly by using this carrying belt 50, and this straw rice-bag type may be box type, bag type or proper shape luggages.

Namely, this carrying belt 50 is used in such a way that in the condition where the article 55 to be carried as shown in FIG. 9 is placed on the parallel belt section 54, two pieces of bars 53 are tied (FIG. 10) at mutual parallel positions while keeping a belt interval B suitable for the size of the article, and in case the carrying item is of relatively light weight, it can be carried by holding the U-shaped handle portion 52, and in case the carrying item is of relatively heavy weight, the portions closer to the bar 53 of the parallel belt section 54 are previously loosened and the item can be carried by shouldering it in ordinary manner upon passing one's arms through the loosened portions.

As described in the foregoing, in order that the gist of the embodiment be understood, the using condition of these bars is described prior to the description of construction and operation of a pair of bars 53 that is one of the features of this device.

The description is provided in the following on a pair of bars 53 capable of providing the foregoing using condition.

The reason for showing a pair of bars 53 in a tubular shape whose cross section is semicircular shape as an example is convenience for tieing with a ring 56 provided that both are connected (FIG. 10) to make a configuration like a piece of a round bar, and a square or any other cross sections may be applicable. Joining surfaces 57 of both bars are formed in flat shape or provision of convex portion 58 and concave portion 59 for coupling positioning on the flat surface 57 meets the purpose of example, and the coupling ring 56 may be substituted with relatively strong rubber ring not shown. Also, the shape and structure of a pair of bars 53 may be made identical.

The inner structure of each bar 53 will be described in the following in which it shows a hollow tubular shape as a whole, and at both end portions and preferably in the middle portion (not shown), a cross wall 61 is provided and is useful for reinforcement, but it is not indispensable portion for the inherent purpose. The bar 53 is provided with slits 62 and 63 of lengthwise direction on upper and lower surfaces as shown in the cross section in FIG. 12 taken along a line XII—XII of FIG. 9, and the length is arranged to be longer than the width of the belt preferably so that this belt can slide laterally in the slit. These slits are shown in two pieces on the upper and lower surfaces but if the strength of the bar is sufficient, a longer one piece of slit may be provided on each upper and lower surfaces.

Figure 12:
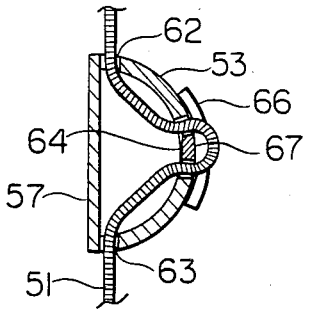

The slit shown with 64 in FIG. 12 is a slit provided at length and position corresponding to slits 62, 63 at the side of the bar 53, and the width is made to be about a thickness equal to a thickness of at least a two-folded belt 51.

As will be obvious from FIG. 12; the belt 51 is made to pass through the slits 62, 63 on the upper and lower surfaces of the bar 53, and a proper wire (not shown) is inserted into the slit 64 to draw the belt 51 out of the slit 64.

Figure 10:
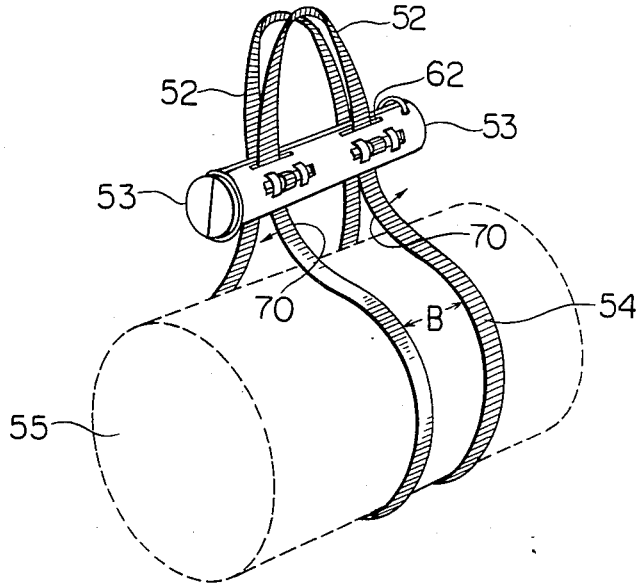
Figure 11:
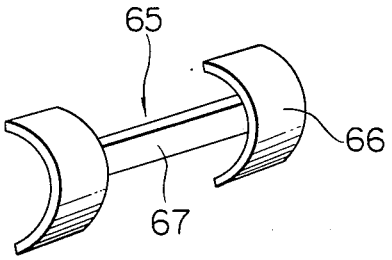

FIG. 11 is a perspective view showing a hooking member 65 for supporting the belt 51 at the outside of the slit 64, and the hooking member 65 comprises a lateral bar 67 for hooking the belt 51 and saddle portions 66 bulging sideways at both ends of the lateral bar and once the belt 51 is sufficiently pulled out of the slit 64, the belt 51 is hooked on the lateral bar, whereby the belt is tensioned vertically, and the belt can be fixed to a required location against the bar 53 in the condition of FIG. 12, namely, as shown in FIG. 9 and FIG. 10. By the way, in case of FIG. 12, the saddle portion 66 of the hooking member 65 abuts on the outer surface of the bar 53, and the lateral bar 67 performs the action of partly fitting into the slit at the side of the bar 53 and engaging the belt 51 with the inside edge of the slit 64 powerfully and it should be understood that the width of the slit in this case is larger nearly by the width of the lateral bar than a double of the thickness of the belt 51.

The carrying belt of the construction that has been described partly together with its operation can be used as follows.

As for the carrying belt 50 of this embodiment, as a matter of fact, a proper belt (assuming that several kinds are ready as the products) can be used according to the size of an item anticipated to be carried, but in case the belt 50 is applied over the carrying item 55 (condition of FIG. 10), it is desirable to adjust the position of both bars 53 to a degree of leaving a certain cavity in the upper part of the carrying item 55 sufficient for passing the shoulders.

After the carrying item 55 is mounted on the inside of the parallel section 54 of the belt, both bars 53 are mutually connected, and the carrying item becomes easily carriable condition as shown in FIG. 10 by using the positioning convex and concave portions 58 and 59 and the coupling ring 56. Particularly, in case of light weight carrying item, the carrying can be made by holding the handle portion 52, but as shown with a symbol 70 in FIG. 10, the arm is inserted to carry on the back easily for transportation. Explanation for the removal of the belt after the carrying is omitted as it is self evident.

Also, the length of each slit 62, 63, 64 is arranged to be longer than the width of the belt 51 so that a distance B of the parallel section of the belt can be adjusted according to a necessity.

By the way, the belt 51 shown in the drawing is illustrated in endless mode, in the assembling process with the bar 53, if necessary, a proper connecting rivet (not shown) or an optional clamping connecting member (not shown) may be provided.

Finally, as a modification of this embodiment, the following arrangement can be made. A cut 71 (shown in dotted line) is provided in the vertical direction on the plane 57 at the side portion of the bar 53 of FIG. 9 to connect the slits 62, 63 on the upper and lower surfaces, and the width of this cut is made at least to be more than a thickness of the belt 51. If the required width is provided, the endless belt 51 can be mounted in the bar in endless condition without obstructing the coupling motion of the bar, or can be removed which is convenient.

Numerous changes may be made in the above-described belt clamping device and different embodiments of the invention may be made without departing from the sprit; therefore, it is intended that all matters contained in the description and the accompanying drawings shall be interpreted as illustrative and not in a limiting sense.

What is claimed is:

1. An assembly of a pair of band clamping devices for being mounted horizontally spaced from each other on at least one side of luggage to be carried to clamp a luggage carrying band in an inverted U-shaped configuration to form handle portions on an upper side of the clamping devices and parallel carrying portions on the lower side of the clamping devices, each clamping device comprising:

a base through which the band may pass orthogonally, said base having a horizontally elongated base plate fixed on the side of the luggage, and an elongated frame integral with and perpendicular with respect to said elongated base plate, said elongated frame having upper and lower elongated openings respectively adjacent to said base plate, and an elongated main opening communicating with said pair of elongated openings and laterally opening with respect to said base, said elongated main opening and said elongated lower and upper openings having a length longer than the width of the band to form an internal passage to allow the band to orthogonally pass through said base portion, a fitting for mounting on the base, said fitting having a central bracket portion engaging and retaining a portion of the band in said elongated main opening at a position nonaligned with respect to said lower and upper openings, and having a pair of leg portions formed integral with said bracket portion and horizontally slidable along the outside of said elongated frame of said base portion, said elongated openings being sufficiently longer than the width of the band and the fitting such that the band is laterally adjustable with respect to the other band clamping device, whereby the length of the handle portions of the inverted U-shaped band and the length of the parallel portions of the band and the distance between the parallel portions of the band may be manually adjusted to facilitate insertion of the arms and shoulders of a carrier of the luggage, and after the manual adjustment the carrying band may be clamped by pulling the parallel portions of the band.

2. The assembly as defined in claim 1, wherein the inside of the leg portion of the fitting has cooperating snap fastener connection parts engageable with cooperating snap fastener connection parts on the outside of the frame of the base.

3. The assembly as defined in claim 2, wherein the snap fastener connection parts include a groove and a projection.

4. The assembly claim 1, further comprising a piece of luggage onto which said assembly is mounted.

5. The assembly of claim 4, said luggage having casters on its bottom.

6. The assembly of claim 1, further comprising a luggage carrying band connected with said luggage.

7. The assembly of claim 6, said luggage having casters on its bottom.

8. An assembly of a pair of band clamping devices for use with a carrying band connected with a piece of luggage, each device comprising, in combination:

a base, base mounting means for mounting said base on a piece of luggage, band holding means on said base for holding a carrying band, a fitting, band holding means on said fitting for holding a carrying band, means on said fitting for providing slidable lateral movement of the fitting on said base, and cooperating means on said base and said fitting for permitting the fitting to slidably move laterally on said base and for releasably locking the fitting onto the base with the base band holding means misaligned with respect to the fitting band holding means to prevent longitudinal movement of the band and arranged so that when the fitting is not locked onto the base, the base band holding means are further misaligned with respect to the fitting whereby when a carrier pulls on the band in a direction away from the device, the band will move the fitting into locking engagement with the base and the band will be prevented from moving longitudinally, said base band holding means, fitting band holding means, fitting means, and cooperating means configured to permit lateral adjustment of the band with respect to the other band clamping device when the fitting slides laterally on said base.

9. The assembly of claim 8, further comprising a piece of luggage onto which said assembly is mounted.

10. The assembly of claim 9, said luggage having casters on its bottom.

11. The assembly of claim 8, further comprising a luggage carrying band connected with said luggage.

12. The assembly of claim 11, said luggage having casters on its bottom.

* * * * *